United States Patent [19]

Friedman

[11] 4,184,341

[45] Jan. 22, 1980

[54] SUCTION PRESSURE CONTROL SYSTEM

[75] Inventor: Donald E. Friedman, Creve Coeur, Mo.

[73] Assignee: Pet Incorporated, St. Louis, Mo.

[21] Appl. No.: 892,777

[22] Filed: Apr. 3, 1978

[51] Int. Cl.[2] ..... F25B 7/00

[52] U.S. Cl. ..... 62/175; 62/228; 62/510; 236/1 EA

[58] Field of Search ..... 62/228 D, 175, 510; 236/1 EA; 200/1 B, 83 T, 81.4, 81.5; 137/513.3, 513.5, 513.7, 115, 493

[56] References Cited

U.S. PATENT DOCUMENTS

| | | | |
|---|---|---|---|
| 3,199,306 | 8/1965 | Paul | 62/158 |
| 3,513,662 | 5/1970 | Golber | 62/115 |
| 3,791,161 | 2/1974 | Kramer | 62/228 D |

*Primary Examiner*—William E. Wayner

*Assistant Examiner*—Harry Tanner

*Attorney, Agent, or Firm*—Richard G. Heywood

[57] ABSTRACT

A refrigeration system including multiple parallel compressors for maintaining evaporator suction pressures within preselected ranges, said compressors being sequentially and cyclically operative through control switch means responsive to preselected upper and lower refrigerant suction pressures, a fluidic time delay system for operating the pressure responsive switch means comprising restrictor means interposed between the common suction header for the compressors and the pressure responsive switch means therefor to restrict refrigerant fluid flow to the pressure switches upon increases in suction header pressure, and unidirectional flow means for providing unrestricted reduction of the pressure acting on the switch means upon relative decreases in suction header pressure.

11 Claims, 1 Drawing Figure

SUCTION PRESSURE CONTROL SYSTEM

BACKGROUND OF THE INVENTION

The invention relates generally to multiple compressor refrigeration systems, and more particularly to improvements in suction pressure controls for the compressors.

In recent years many advances have been made in the refrigeration art and especially in the commercial refrigeration field, which includes supermarket refrigeration and like installations having heavy refrigeration requirements over a wide range of temperatures from about −40° F. to about 50° F. So-called central refrigeration systems of the heavy multiplexing type utilize several compressors (typically either two or four) connected for parallel operation to effect refrigerant flow to and from the evaporators of a large number of refrigerated fixtures. Multiple compressor systems are generally controlled by pressure sensitive switches responsive to the suction pressure at the compressors intake so that as the suction pressure fluctuates in response to increases or decreases in system loads, the compressors will cycle on and off to maintain the common suction pressure on the system within prescribed limits as required to maintain proper temperature control of the refrigerated fixtures.

Fluctuation of the suction pressure is influenced by various internal (system) factors including temperature controls, defrosting apparatus and the like, and by several external factors including product loading of refrigerated fixtures, ambient temperatures and the like, and at times sudden transient increases in suction pressure may cause one or more idle compressors to start thereby rapidly reducing the suction pressure to the point where such compressors will cycle off again. Since these suction pressure changes are frequently transient in nature, the capacity of the operating compressors in the system would often be adequate to restore the normal suction pressure operating the system before there is any significant influence on the refrigerated compartment temperatures of the fixtures. However, if the thermal load change causing the suction pressure (temperature) rise is of long duration, then the operation of one or more additional compressors may be necessary to maintain normal refrigerated compartment temperatures.

It is apparent that electric power consumption will be reduced in the overall operation of the refrigeration system if additional compressors are not started in response to transient load increases. In the past, electric time delay relays have been used for elaying the start of additional compressors sensing an increase in suction pressure, but such electric relays are insensitive to the actual magnitude of suction pressure, whereby the compressor controlled thereby will start no matter how small the difference between actual suction pressure and the pressure switch setting of the compressor. In short, heretofore there has been no simple, positive acting, suction pressure control for effectively obviating on/off compressor cycling due to sudden temporary or transient suction pressure changes.

SUMMARY OF THE INVENTION

The invention is embodied in a multiple compressor refrigeration system in which the compressors are connected in parallel to draw refrigerant vapor from a common suction header and to discharge compressed refrigerant to a common delivery header, control switch means having upper and lower pressure settings for starting and stopping the compressors in a predetermined sequential order to maintain the suction header pressure within a predetermined range, and a time delay system connecting the control switch means to the suction header comprising restrictor means for delaying refrigerant flow and concomitant vapor pressure communication from the suction header to the control switch means and one-way flow means for providing unrestricted refrigerant flow and concomitant vapor pressure communication from the control switch means back to the suction header.

The principal object of the present invention is to provide improved suction pressure controls for a multiple compressor refrigeration system to substantially reduce short term on/off compressor cycling due to sudden transient changes in suction pressure.

Another object is to provide a fluidic time delay interposed between the suction header and the pressure sensitive switching means of multiple parallel compressors for preventing sudden pressure increases in the suction header from being imposed on the pressure switches and affording immediate pressure equalization from the pressure switches to the suction header upon decreases in suction pressure therein.

Another object is to provide a simple, positive acting, pressure delay control for operating the pressure sensitive switches of multiple parallel compressors and for stabilizing fluctuating transitory loads to minimize on/-off compressor cycling.

These and still other objects and advantages will become more apparent hereinafter.

BRIEF DESCRIPTION OF THE DRAWING

The single FIGURE drawing is a diagrammatic illustration of a multiple compressor refrigeration system embodying a presently preferred embodiment of the invention.

DESCRIPTION OF THE PREFERRED EMBODIMENT

Figure 1:
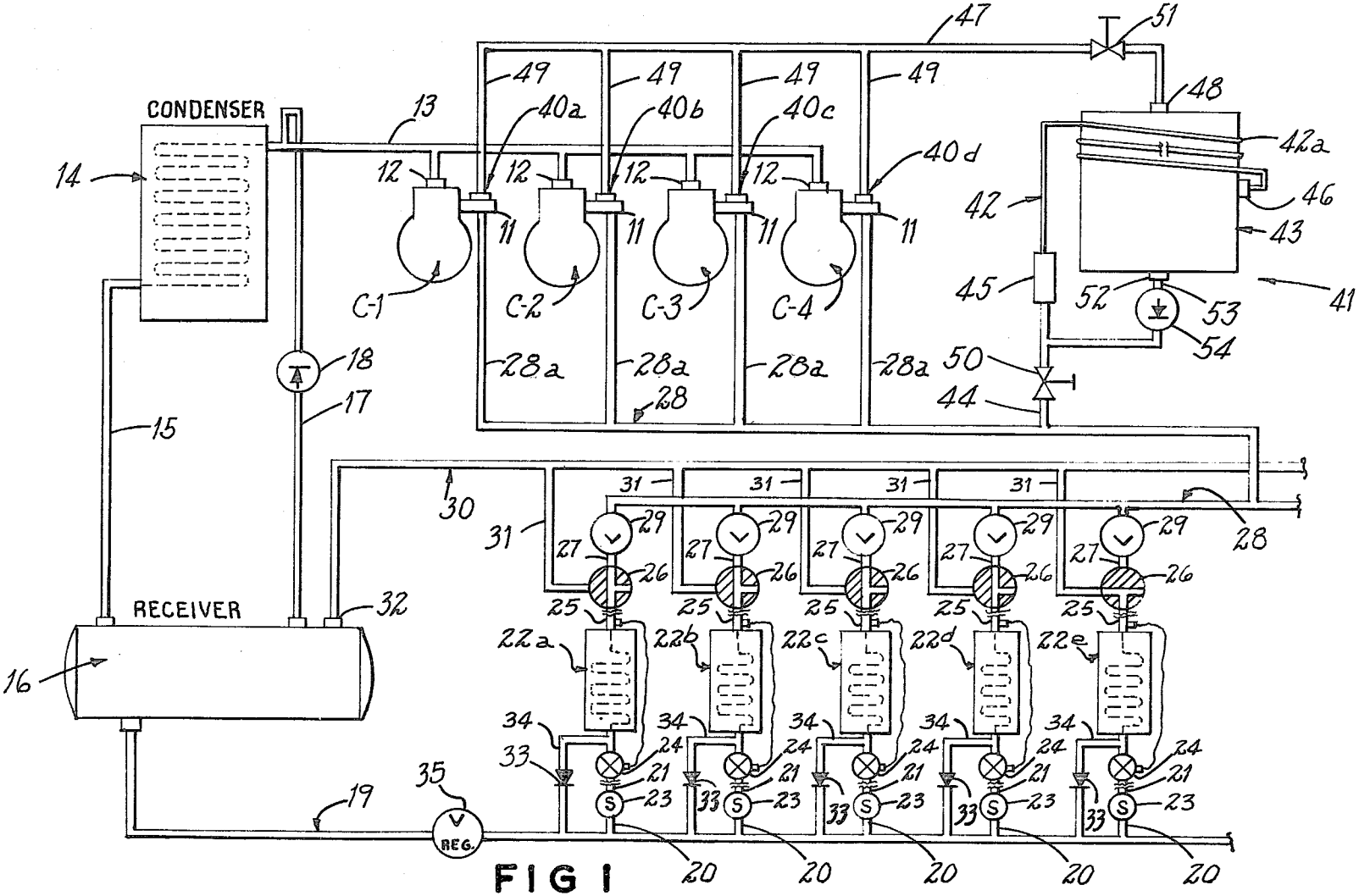

For purposes of disclosure, a central or multiplexed refrigeration system of the type having plural (at least two) compressors will be described as being installed in a supermarket for operating a multiplicity of separate refrigerated fixtures, such as refrigerated storage and display cases, but it will be understood and readily apparent to those skilled in the art that such a system can be adapted to other commercial or industrial installations. The terms "high side" and "low side" are used herein in a conventional refrigeration sense to mean the portions of the system from the compressor discharge to the evaporator expansion valves and from the expansion valves to the suction intake of the compressors, respectively.

The central refrigeration system illustrated in the drawing includes four parallel compressors C-1, C-2, C-3 and C-4, each of which has a suction or low pressure intake 11 operating within a range of preselected suction pressures (as will be described more fully) and a discharge or high pressure side 12 with a common discharge header or conduit 13 through which hot compressed gaseous refrigerant is discharged to a condenser 14. The refrigerant is reduced to its condensation temperature and pressure in the condenser 14, which is connected by conduit 15 to a receiver 16 forming a liquid refrigerant source for operating the system (a conventional equalization line 17 with a one-way check valve 18 connects the top of the receiver 16 to the top of the condenser 14). The bottom of the receiver 16 is connected to a liquid header 19 for conducting liquid refrigerant to branch liquid lines or conduits 20,21 leading to evaporator coils 22*a*, 22*b*, 22*c*, 22*d* and 22*e*, which are representative of a multiplicity of different refrigerated fixtures (not shown). The branch liquid line 20 for each evaporator 22*a*, 22*b*, 22*c*, 22*d* and 22*e* is connected to a solenoid valve 23, and branch liquid line 21 leading therefrom is broken to illustrate an indeterminate length from the machine room to the refrigerated fixture. Expansion valves 24 are provided in the liquid lines 21 for metering refrigerant into the evaporator coils 22*a*–22*e* in a conventional manner during their refrigeration cycle. The outlets of the evaporators are connected by branch suction lines 25 (also broken to illustrate an indeterminate length) to three-way valves 26 and, under normal refrigerating operation, are connected through these valves and branch suction lines or conduits 27 to a common suction line or header 28 connected by compressor suction lines 28*a* to the suction inlets 11 of the compressors C-1, C-2, C-3 and C-4 and through which vaporous refrigerant from the evaporators is returned to the compressors to complete the basic refrigeration cycle. Evaporator pressure regulator (EPR) valves 29 are shown interposed in the branch suction lines 27 for illustrating that the suction pressure on the respective evaporator coils 22*a*–22*e* can be adjusted so that the respective refrigerated fixtures can operate at different temperatures within the range of suction pressures maintained by the compressors C-1, C-2, C-3 and C-4.

The refrigeration system operates in a conventional manner in that each fixture evaporator absorbs heat from the fixture or its product load thereby heating and vaporizing the refrigerant and resulting in the formation of frost or ice on the evaporator coils 22*a*–22*e*. In this type of system it is generally necessary to effect a short, but complete, defrost of each evaporator periodically to remove the frost accumulation thereon. The number of evaporators in the refrigeration system produce a cumulative latent heat load of the refrigerant gas returned to the compressor, and this heat load is in excess of the amount of heat required to defrost one or more of the evaporators 22*a*–22*e* (sometimes called a "superabundance" of heat). A main gas defrost header 30 is provided for conducting gaseous refrigerant selectively to the evaporator coils and is connected through branch defrost lines or conduits 31 to the three-way valves 26, the three-way valve for the evaporator 22*e* being shown in defrost position.

In a conventional "hot gas" defrost arrangement the defrost header 30 would be connected to the compressor discharge conduit 13 so that this source of highly superheated hot compressed gaseous refrigerant would be used for selectively defrosting the evaporators 22*a*–22*e*. However, for disclosure purposes, the defrost header 30 is connected to the top of the receiver 16, as at 32, so that "saturated gas" from the receiver is used for defrosting purposes; that is, the sensible and latent heat of gaseous refrigerant at its normal or desuperheated saturation temperature is utilized for defrosting the evaporators. Accordingly, the gas defrost header 30 is connected to the top (32) of the receiver 16, which provides a continuous supply of saturated gas at substantially the head pressure of the compressors, so that such gaseous refrigerant will flow through the header 30, the branch line 31 and the three-way valve 26 into the evaporator coil 22*e* (or other selected evaporators periodically isolated from their normal refrigeration cycle by actuating their respective three-way valves 26 and solenoid valves 23) for heating the coil and thereby condensing the refrigerant to its liquid phase as in a conventional condenser. A unidirectional by-pass or check valve 33 is provided in a by-pass line 34 connecting the inlet of each of the evaporators 22*a*–22*e* to the liquid header 19 in by-pass relation with the expansion valves 24. In accordance with the teachings of Blake U.S. Pat. No. 3,150,498, the defrost system disclosed provides for the return of the liquid refrigerant resulting from the defrost of each evaporator coil directly into the liquid header 19 through the by-pass line 34 and check valve 33 so that such refrigerant is immediately available for use in the operation of the normally refrigerating evaporators. A pressure reducing or regulating valve 35 is positioned in the liquid header 19 upstream of the branch liquid supply lines 20; the pressure drop effected by the valve 35 from the receiver side of liquid header 19 to the evaporator side being in the range of about 15 to 40 p.s.i.g. Accordingly, a pressure differential between the defrost gas header 30 and the liquid header 19 is maintained to provide an incentive for the rapid flow of refrigerant through the defrosting evaporator 22*e* (or other periodically selected evaporator) back into the high side of the refrigeration system.

The compressors in conventional refrigeration systems are typically controlled by one or more multi-switch pressure controllers or a series of separate pressure switches having preselected high and low pressure settings which sense and are directly responsive to the low side suction pressure at the compressor intake (11) for starting and stopping the compressors. In a typical multiple compressor refrigeration system, in which the compressors are connected in parallel to draw refrigerant vapor from a common low side suction header (28) and to discharge compressed or pressurized refrigerant vapor through a common high side delivery header (13) to a condenser (14), the high or cut-in pressure settings for the multiple compressors are arranged in a preselected increasing progression to sequentially start the compressors only as required to meet increasing load demands and the cut-out or low pressure settings also vary in a preselected progression to stop the compressors sequentially as the system load evidenced by the suction pressure is reduced. In other words, the normal refrigeration load of the system may normally produce a suction pressure in the range of 10 p.s.i.g. to 12 p.s.i.g. whereby the operation of two or three compressors in a four compressor system will be sufficient to satisfy the refrigerant requirements or load demands. However, in the event of sudden transient increases in suction pressure as when the defrost cycle is terminated on one or more selected evaporators (22*e*), the suction header pressure may rise very rapidly (such as to 35 p.s.i.g. or the like) whereby the cut-in or high pressure settings of the control switches for all of the system compressors may be exceeded and all of these compressors will be started thereby rapidly reducing the suction pressure back below the cut-out or low pressure control settings of some of the compressors so that they will cycle off. Manifestly, such rapid on-off cycling of compressors consumes unnecessary energy by reason of the fact that the operative compressors at the time of the surge in suction pressure may have been adequate to restore substantially normal suction pressure levels.

According to the present invention, conventional types or arrangements of pressure responsive control switches 40*a*, 40*b*, 40*c* and 40*d* may be provided for controlling the operation of the compressors C-1, C-2, C-3 and C-4, respectively; i.e. such control switches 40*a*–40*d* may be of the conventional multi-switch controller type having a multiplicity of ganged switch contacts simultaneously actuated by a single pressure element or may be a series of separate or paired sets of conventional switches actuated by different pressure elements, the construction and operation of these conventional switch means being well known in the refrigeration art. It will also be understood that in conventional systems the location of suction pressure control switches is generally at the suction intake (11) of the compressors or in communication with the compressor suction lines 28*a* leading thereto from the suction manifold 28; whereas in the present system, the physical location of the control switches 40*a*–40*d* may be remotely located away from the compressors electrically controlled thereby, as will appear. For disclosure purposes, however, these switches 40*a*, 40*b*, 40*c* and 40*d* are diagrammatically illustrated as being positioned adjacent to the suction intake 11 of each of the compressors C-1, C-2, C-3 and C-4, respectively, but they are isolated from the compressor suction inlets 11 and suction lines 28,28*a* and are arranged for compressor control operation through a fluidic time delay system 41, as will now be described.

The time delay system 41 is interposed between the suction header 28 and each of the pressure responsive control switches 40*a*–40*d* for regulating the vapor pressure imposed on these switch means to thereby electrically control the operation of the compressors C-1 through C-4. The time delay relay 41 is physically positioned above the suction header 28 to prevent the entrapment of coil therein, and comprises fluid restrictor means in the nature of a capillary tube 42 and an accumulator tank 43 to restrict refrigerant flow from the suction header and thereby delay the concomitant vapor pressure increase effective on the pressure switches during increasing suction header pressures. A conduit 44 connects the suction header 28 to one end of a fine mesh strainer 45 for trapping any solid particles entrained in the refrigerant vapor flow and preventing the passage of such matter into the capillary tube restrictor 42 connected to the outlet of the strainer 45. It will be noted that the strainer is vertically disposed and in gravity flow relationship with the suction header 28. The capillary tube 42 comprises a substantial length of small bore tubing which is helically wound around the upper portion of the accumulator tank 43 in a gravity flow, downward spiralling series of turns 42*a* (shown broken to illustrate additional turns) and having its inlet connection 46 in the side wall of the accumulator intermediate its top and bottom ends. A conduit 47 is connected to the top 48 of the accumulator, and is connected by branch conduits 49 to each of the pressure control switches 40*a*, 40*b*, 40*c* and 40*d* to provide open fluid communication between the internal pressure actuator elements (not shown) of the switches and the upper portion of the accumulator 43. Normally open service hand valves 50 and 51 are provided in the conduits 44 and 47, respectively. It will be understood that the restrictor means utilizes capillary (flow restricting) tubing 42 of predetermined length and bore size and an accumulator 43 of predetermined volume which together are calculated to obtain optimum time delay in the flow of refrigerant vapor from the suction header 28 to the pressure switches 40*a*–40*d*. Manifestly, a capillary of smaller bore and/or an accumulator of larger size will result in longer time delays.

The time delay system 41 also includes fluid return or pressure equalizing means comprising a conduit 53 connecting the bottom 52 of the accumulator tank 43 to the conduit 44 between the strainer 45 and the hand valve 50, and a ne-way check valve 54 is provided in the conduit 53 to provide relatively unrestricted, but unidirectional, refrigerant flow from the bottom of the accumulator tank back to the suction header 28 upon relative decreases in the suction pressure therein.

The components of the time delay system 41 may be conveniently arranged in a suitable housing (not shown) mounted in gravity flow position above the suction manifold 28 and the compressors C-1, etc.; and the pressure control switches 40*a*–40*d* may be incorporated into such housing thereby requiring only relatively short conduit connections 47,49 between the accumulator 43 and the internal pressure actuator (not shown) of the compressor sequencing switches 40*a*–40*d*.

In operation, it will be understood that the pressure settings of the compressor control switches 40*a*–40*d* will be determined primarily by the requirements of the refrigeration system, type of refrigerant, load variables and the like. In a four compressor system (as illustrated ) for low temperature (frozen food) operation at −25° F. using Refrigerant 502, a typical suction header pressure range of about 4 p.s.i.g. to 15 p.s.i.g. would be maintained and a normal suction pressure level of about 10 p.s.i.g. to 12 p.s.i.g. would typically be established during normal, stable refrigerating conditions. Accordingly, in describing the operation of the fluidic time delay system 41 under these conditions, the sequencing switches 40*a*–40*d* may have the following high or cut-in and low or cut-out pressure control settings for starting and stopping the compressors:

| Compressor | Switch | Cut-In | Cut-Out |
|---|---|---|---|
| C-4 | 40d | 15 p.s.i.g. | 10 p.s.i.g. |
| C-3 | 40c | 13 p.s.i.g. | 8 p.s.i.g. |
| C-2 | 40b | 11 p.s.i.g. | 6 p.s.i.g. |
| C-1 | 40a | 9 p.s.i.g. | 4 p.s.i.g. |

In addition, for purposes of disclosing the operation, it will be assumed that compressors C-1, C-2 and C-3 are running and the suction header pressure is stable at 10 p.s.i.g., that the pressure in the accumulator tank 43 is balanced at 10 p.s.i.g., that compressor C-4 is stopped, and that all evaporators 22*a*–22*e* are connected for normal refrigeration.

Under such circumstances, a defrost cycle is initiated for evaporator 22*e* by closing its solenoid valve 23 and switching the three-way valve 26 to the position shown, thereby resulting in a drop in the system load and reducing the suction header pressure to 6 p.s.i.g. A pressure differential is thus created between the suction header 28 and the accumulator tank 43 causing the check valve 54 to open and the accumulator pressure to rapidly equalize at 6 p.s.i.g. which is below the 8 p.s.i.g. cut-out pressure of compressor C-3 causing that compressor to stop and the suction header pressure to slowly rise to 8 p.s.i.g. due to the reduced compressor capacity and the accumulator pressure will also slowly rise but lag behind by a pound or two due to the restrictive flow through the capillary tube 42. However, compressor C-3 remains idle and will not start until the accumulator pressure again rises to 13 p.s.i.g.

At the termination of the defrost cycle of evaporator 22e and refrigeration is resumed, the coil is hot from defrosting and the suction pressure affected thereby rapidly rises to 35 p.s.i.g. and this pressure increase is imposed on the fluidic time delay 41. Since the check valve 54 prevents direct pressure equalization to the accumulator 43, vapor flow into the accumulator is restricted through the capillary tube 42 and the concomitant vapor pressure increase in the accumulator 43, which is effective on the pressure switches 40a–40d, is relatively slow. Furthermore, the suction pressure in the header 28 drops rapidly as the warm coil (22e) becomes cold and may read 11 or 12 p.s.i.g. before the effective pressure in the accumulator 43 reaches 13 p.s.i.g., which is the cut-in pressure of compressor C-3. Even if the suction pressure typically levels out and comes down to about 15 p.s.i.g., the rate of fluid flow and/or pressure increase to the accumulator 43 would be slowed down thereby allowing more time for compressors C-1 and C-2 to bring the suction pressure to below 13 p.s.i.g. before the accumulator pressure effective on the pressure switch 40c reaches this cut-in pressure of compressor C-3. In the event the suction pressure on header 28 still exceeds 15 p.s.i.g. when the accumulator pressure reaches 13 p.s.i.g., the compressor C-3 will start rapidly reducing the suction header and accumulator tank pressure back to the 10 p.s.i.g. level.

From the foregoing it will be apparent that the time delay system 41 provides a variable time delay based upon pressure differential. If the suction header pressure rises slowly as when the load changes are due to increasing ambient temperatures or the like, the accumulator pressure will closely follow the suction pressure so that an additional compressor will start when needed without any significant time delay. If the rise in suction header pressure is rapid and substantial, such as 20 to 25 p.s.i.g., due to surges occasioned by defrost operations (as described) or momentary load fluctuations as when cooler doors are opened, the accumulator pressure will follow relatively rapidly if the high pressure differential is sustained. However, if the pressure surge peaks out and then drops rapidly, the differential will, of course, be decreased and the length of time for the accumulator pressure to reach the cut-in point of the next compressor will be increased. It will also be apparent that there is no significant delay in stopping a compressor when the suction header pressure drops below the accumulator pressure, as the one-way check valve 54 provides substantially unrestricted pressure equalization to stop compressors due to lighter load conditions. Effective time delays ranging from about 3 or 4 minutes up to about 15 or 20 minutes due to increasing suction pressures, together with substantially no delay due to pressure drop substantially eliminates short cycling of the compressors.

The foregoing description is given only by way of illustration and example, and the invention is only to be limited by the scope of the claims which follow.

What is claimed is:

1. In a multiple compressor refrigeration system in which the compressors are connected in parallel to draw refrigerant vapor from a common suction source; the improvement comprising pressure responsive switch means having preselected high and low pressure settings for starting and stopping the compressors in a predetermined sequential order for maintaining the suction pressure on the system within a predetermined range, and time delay means connecting the pressure switch means to the suction source comprising restrictor means for restricting refrigerant flow and delaying concomitant vapor pressure communication from the suction source to the pressure switch means, and one-way flow means for providing unrestricted refrigerant flow and concomitant vapor pressure communication from the pressure switch means to the suction source.

2. The refrigeration system according to claim 1, in which said restrictor means of said time delay means comprises a capillary tube.

3. The refrigeration system according to claim 1, in which said one-way flow means comprises a unidirectional check valve.

4. The refrigeration system according to claim 1, in which said restrictor means of said time delay means comprises a refrigerant flow restricting device in combination with accumulator means.

5. The refrigeration system according to claim 4, in which said flow restricting device has an inlet end in substantially unrestricted flow communication with said suction source and an outlet end connected to said accumulator means.

6. The refrigeration system according to claim 5, including strainer means connected between the suction source and the inlet end of said flow restricting device.

7. The refrigeration system according to claim 4, in which said accumulator means comprises an accumulator tank having an upper outlet connection with said pressure switch means, a lower outlet connection with said one-way flow means and an intermediate inlet connection with said flow restricting device.

8. The refrigeration system according to claim 7, in which said flow restricting device comprises a capillary tube of preselected length and bore size, said capillary tube being helically wound around said accumulator tank for gravity refrigerant flow to the inlet connection thereto.

9. The refrigeration system according to claim 7, including strainer means connected between the suction source and said refrigerant flow restricting device and in gravity flow relation with the former, and said one-way flow means comprises a unidirectional check valve having an outlet in communication with the suction source below said strainer means.

10. A suction pressure control system for regulating the on-off cycling of compressors in a multiple compressor refrigeration system in which the compressors are connected in parallel to a common suction header, pressure responsive switch means having preselected high and low pressure settings for sequentially starting and stopping the individual compressors in response to progressive increases and decreases in the suction header pressure, variable time delay means interposed between the suction header and said switch means comprising a refrigerant flow restricting device having an inlet side connected to the suction header for delaying the flow of refrigerant vapor therethrough due to pressure increases in the suction header, accumulator means having an inlet connection with the outlet side of said flow restricting device, said accumulator means having an upper outlet connected to said switch means and having a lower outlet below said inlet connection and one-way flow means adapted to establish fluid flow communication from said lower outlet connection to the suction header on the inlet side of said flow restricting device due to a pressure decrease in the suction header relative to the pressure in said accumulator means.

11. The pressure responsive control system according to claim 10, in which the variable time delay means are disposed in an elevated, gravity flow position relative to the suction header for preventing oil entrapment therein, and strainer means on the inlet side of said flow restricting device and in vertical, gravity flow relation with said suction header.

* * * * *